US006994346B1

(12) United States Patent
Velasquez

(10) Patent No.: US 6,994,346 B1
(45) Date of Patent: Feb. 7, 2006

(54) AERIAL PROJECTILE TARGET GAME

(76) Inventor: Tomas L. Velasquez, P.O. Box 730, Alcalde, NM (US) 87511

( * ) Notice: Subject to any disclaimer, the term of this patent is extended or adjusted under 35 U.S.C. 154(b) by 0 days.

(21) Appl. No.: 10/989,193

(22) Filed: Nov. 15, 2004

(51) Int. Cl.
*A63B 67/06* (2006.01)

(52) U.S. Cl. ..... 273/336

(58) Field of Classification Search ..... 273/336–339; 473/588, 589
See application file for complete search history.

(56) References Cited

U.S. PATENT DOCUMENTS 626,328 A * 6/1899 Kroscher et al. ..... 273/338
3,003,767 A 10/1961 Keuls
3,014,723 A * 12/1961 Butler ..... 273/350
3,115,340 A * 12/1963 Stasiuk ..... 473/414
3,815,915 A 6/1974 Chapman
3,823,942 A * 7/1974 Duncan ..... 473/514
4,531,745 A * 7/1985 Leidy ..... 273/336
4,593,912 A * 6/1986 Rivas et al. ..... 273/339
4,726,591 A 2/1988 Johnson
4,898,392 A 2/1990 Goletz
4,936,590 A 6/1990 Palmer
4,966,373 A * 10/1990 Houle et al. ..... 273/339

* cited by examiner

*Primary Examiner*—Raleigh W. Chiu
(74) *Attorney, Agent, or Firm*—Donald R. Schoonover

(57) ABSTRACT

A tossing game includes a projectile that is formed of two overlapping annular rings and two spaced apart stakes at which the rings are tossed. The overlapping nature of the rings defines a plurality of areas, and each area is assigned a point value. Points are awarded to the players depending on where and how the overlapping rings comes to rest with respect to the stakes.

1 Claim, 2 Drawing Sheets

A METHOD OF PLAYING A TOSSING GAME

ANCHORING TWO STAKES IN THE GROUND AT SPACED APART LOCATIONS

↓

PROVIDING A PROJECTILE WHICH INCLUDES A FIRST ANNULAR RING HAVING A CIRCULAR PERIPHERY, A SECOND ANNULAR RING HAVING A CIRCULAR PERIPHERY, THE PERIPHERY OF THE FIRST ANNULAR RING INTERSECTING THE PERIPHERY OF THE SECOND ANNULAR RING AT FIRST AND SECOND LOCATIONS, WITH THE FIRST LOCATION BEING SPACED APART FROM THE SECOND LOCATION ALONG A SECANT OF THE FIRST AND SECOND ANNULAR RINGS, A FIRST AREA IN THE FIRST ANNULAR RING DEFINED BY THE PERIPHERY OF THE FIRST ANNULAR RING BETWEEN THE FIRST LOCATION AND THE SECOND LOCATION, A SECOND AREA IN THE SECOND ANNULAR RING DEFINED BY THE PERIPHERY OF THE SECOND ANNULAR RING BETWEEN THE FIRST LOCATION AND THE SECOND LOCATION, THE FIRST AREA BEING EQUAL IN SIZE TO THE SECOND AREA, AND A THIRD AREA DEFINED BY THE PERIPHERIES OF THE FIRST ANNULAR RING AND THE SECOND ANNULAR RING BETWEEN THE FIRST AND SECOND LOCATIONS, THE THIRD AREA BEING SMALLER IN SIZE THAN THE FIRST AND SECOND AREAS

↓

ASSIGNING A NUMERIC VALUE TO EACH AREA OF THE FIRST, SECOND AND THIRD AREAS

↓

STANDING ADJACENT TO ONE STAKE OF THE TWO STAKES AND TOSSING THE PROJECTILE AT THE OTHER STAKE OF THE TWO STAKES

↓

SCORING POINTS BASED ON THE NUMERIC VALUES DEPENDING ON THE RELATIONSHIP OF THE PROJECTILE TO THE OTHER STAKE AFTER THE PROJECTILE HAS COME TO A REST

FIG. 3.

AERIAL PROJECTILE TARGET GAME

BACKGROUND OF THE INVENTION

1. Field of the Invention

The present invention relates to the general art of amusement devices and, without limitation, to the particular field of aerial projectile and target games.

2. Description of the Related Art

Many people enjoy playing various games. These games often are played out of doors and some of the games involve tossing an object at a target. Horse shoes is a primary example of such a game.

The amusement art contains many examples of target games which include tossing an object at the target and scoring points based on the accuracy of the toss. However, the inventor is not aware of any game in which the object tossed can score a variety of points due to the shape of the object.

Therefore, there is a need for an aerial projectile target game in which the shape of the object being tossed has a determining factor in the outcome of the game.

To be most successful, any such game should be easy to set up, and easy to play and score. This will permit players of all ages to play the game and will encourage people to play the game since it is easy to set up to learn and to play.

Therefore, there is a need for an aerial projectile target game which is easy to learn, easy to set up, and easy to play.

The inventor has found that the sound of a projectile contacting a target provides a sensory feedback that enhances the enjoyment of the game.

Therefore, there is a need for an aerial projectile target game in which the shape of the object being tossed has a determining factor in the outcome of the game and also provides an enjoyable audible feedback to the players during the game.

Still further, many tossing target games are restricted to two players. However, enjoyment of such a game is often enhanced if team play can be effected.

Therefore, there is a need for an aerial projectile target game in which the shape of the object being tossed has a determining factor in the outcome of the game, which provides an enjoyable audible feedback to the players during the game, and which is amenable to team play.

PRINCIPAL OBJECTS OF THE INVENTION

It is a main object of the present invention to provide an aerial projectile target game in which the shape of the object being tossed has a determining factor in the outcome of the game.

It is another object of the present invention to provide an aerial projectile target game which is easy to learn, easy to set up, and easy to play.

It is another object of the present invention to provide an aerial projectile target game in which the shape of the object being tossed has a determining factor in the outcome of the game and also provides an enjoyable audible feedback to the players during the game.

It is another object of the present invention to provide an aerial projectile target game in which the shape of the object being tossed has a determining factor in the outcome of the game, which provides an enjoyable audible feedback to the players during the game, and which is amenable to team play.

SUMMARY OF THE INVENTION

These, and other, objects are achieved by a tossing game comprising: two stakes which are anchored in the ground at spaced apart locations; two annular rings which are connected together in overlapping relationship and to define three arcuate sections; each of which has a numeric value assigned thereto. The game is played by players standing adjacent to one stake of the two stakes and tossing the connected rings at the other stake of the two stakes. Points are scored based on the numeric values depending on the relationship of the connected rings to the other stake after the connected rings have come to a rest.

The game embodying the present invention is easy to set up, play, and score. The stakes and the connected rings are steel so a distinctive sound is generated when the rings contact the stakes. This sound enhances the enjoyment of the game.

BRIEF DESCRIPTION OF THE DRAWING FIGURES

FIG. 3 illustrates the steps included in the ring tossing game embodying the present invention.

DETAILED DESCRIPTION OF THE PREFERRED EMBODIMENT

Figure 2:
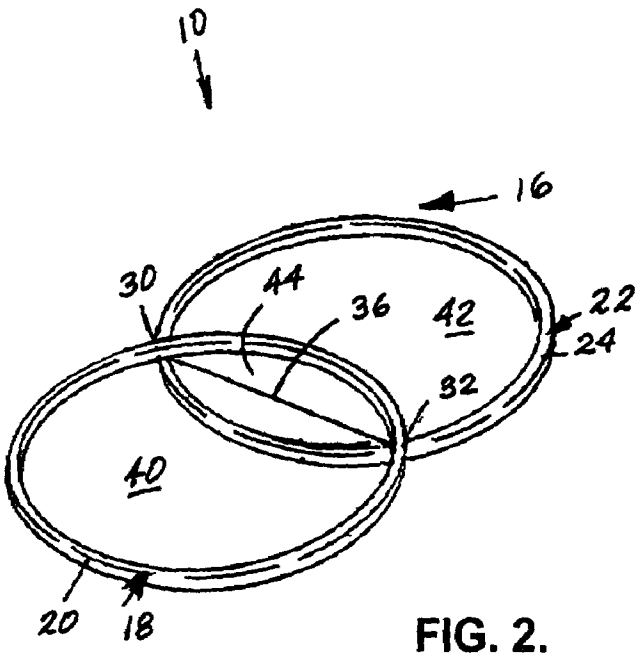
FIG. 2 is a perspective view of the rings used in the ring tossing game embodying the present invention.
Figure 1:
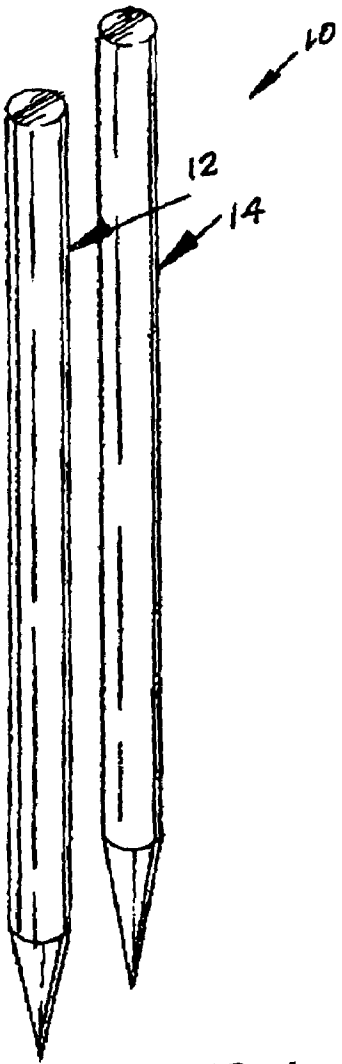
FIG. 1 is a perspective view of two target stakes used in the ring tossing game embodying the present invention.

Other objects, features and advantages of the invention will become apparent from a consideration of the following detailed description and the accompanying drawings.

Referring to the Figures, it can be understood that the present invention is embodied in a tossing game and a method of playing the game.

The game elements include a target 10 which has two identical steel stakes 12 and 14 that are anchored in the ground at spaced apart locations, and a game projectile 16 which is formed of steel and which includes a first annular ring 18 having a circular periphery 20, and a second annular ring 22 having a circular periphery 24.

Periphery 20 of the first annular ring 18 intersects periphery 24 of the second annular ring 22 at a first location 30 and at a second location 32. First location 30 is spaced apart from second location 32 along a secant 36 of the first and second rings 18, 22.

A first area 40 in the first annular ring 18 is defined by periphery 20 of the first annular ring 18 between first and second locations 30 and 32. A second area 42 in the second annular ring 22 is defined by periphery 24 of the second annular ring 22 between first and second locations 30 and 32. As can be understood from FIG. 2, first area 40 is equal in size to second area 42. A third area 44 is defined by the peripheries 20, 24 of the first annular ring 18 and the second annular ring 22 between the first and second locations 30, 32. Third area 44 is smaller in size than the first and second areas 40, 42.

The game includes assigning a numeric value to each area of the first, second, and third areas 40, 42, 44. For example, first area 40 can have a value of ten points, second area 42 can have a value of fifteen, and third area 44 can have a value of 20 points. Thus, for example, if a player standing adjacent to stake 12 tosses projectile 16 at stake 14 and area 44 encircles stake 16 after projectile 16 comes to rest, then the player will receive a score of fifteen points, and so forth. Further points can be assigned to a projectile 16 leaning against a stake 12, 14, such as four points; lying on the ground but touching a stake 12, 14, such as three points; and/or lying on the ground but within one diameter of one of the annular rings 18, 22, such as two points.

The game can be played by having a player stand adjacent to one stake of the two stakes 12, 14 and tossing projectile 16 at the other stake of the two stakes 12, 14; and points are scored based on the numeric values depending on the relationship of the projectile 16 to the other stake after the projectile has come to a rest as discussed above. The game continues until one player reaches forty points, or one player reaches at least forty points and is more than five points ahead of his opponent. Of course, other scoring techniques can be used without departing from the scope of the present disclosure.

The game can be played in teams if desired. Furthermore, the annular rings 18, 22 of projectile 16 can be of various colors to further differentiate players and/or teams. Each player can have his or her own projectile 16 if desired. The stakes 12, 14 can be colored as well if desired.

It is understood that while certain forms of the present invention have been illustrated and described herein, it is not to be limited to the specific forms or arrangements of parts described and shown.

What is claimed is:

1. A method of playing a tossing game which includes (a) anchoring two stakes that in the ground at spaced apart locations;

(b) providing a projectile which includes (1) a first annular ring having a circular periphery, (2) a second annular ring having a circular periphery, (3) the periphery of the first annular ring intersecting the periphery of the second annular ring at first and second locations, with the first location being spaced apart from the second location along a secant of the first and second rings, (4) a first area in the first annular ring defined by the periphery of the first ring between the first location and the second location, (5) a second area in the second annular ring defined by the periphery of the second ring between the first location and the second location, (6) the first area being equal in size to the second area, and (7) a third area defined by the peripheries of the first ring and the second ring between the first and second locations, the third area being smaller in size than the first and second areas;

(c) assigning a numeric value to each area of the first, second and third areas;

(d) standing adjacent to one stake of the two stakes and tossing the projectile at the other stake of the two stakes; and (e) scoring points based on the numeric values depending on the relationship of the projectile to the other stake after the projectile has come to a rest.

* * * * *